US005541631A

United States Patent [19]

Hashimoto

[11] Patent Number: 5,541,631

[45] Date of Patent: Jul. 30, 1996

[54] INK CARTRIDGE INCLUDING PROJECTION FOR PREVENTING ERRONEOUS LOADING

[75] Inventor: Kenichirou Hashimoto, Yokohama, Japan

[73] Assignee: Canon Kabushiki Kaisha, Tokyo, Japan

[21] Appl. No.: 13,223

[22] Filed: Feb. 1, 1993

Related U.S. Application Data

[63] Continuation of Ser. No. 763,447, Sep. 20, 1991, abandoned.

[30] Foreign Application Priority Data

Sep. 22, 1990 [JP] Japan ..... 2-253606
Sep. 17, 1991 [JP] Japan ..... 3-236188

[51] Int. Cl.[6] ..... B41J 2/175

[52] U.S. Cl. ..... 347/86

[58] Field of Search ..... 346/140; 347/86, 347/85, 36

[56] References Cited

U.S. PATENT DOCUMENTS

| | | | |
|---|---|---|---|
| 4,074,284 | 2/1978 | Dexter et al. | 347/86 X |
| 4,119,034 | 10/1978 | Wax | 347/86 X |
| 4,313,124 | 1/1982 | Hara . | |
| 4,345,262 | 8/1982 | Shirato et al. . | |
| 4,459,600 | 7/1984 | Sato et al. | 346/140 R |
| 4,463,359 | 7/1984 | Ayata et al. . | |
| 4,551,734 | 11/1985 | Causley | 347/86 |
| 4,558,333 | 12/1985 | Sugitani et al. . | |
| 4,591,875 | 5/1986 | McCann | 347/86 X |
| 4,695,824 | 9/1987 | Tazaki | 347/86 |
| 4,723,129 | 2/1988 | Endo et al. . | |
| 4,740,796 | 4/1988 | Endo et al. . | |
| 4,949,123 | 8/1990 | Takashima | 355/260 |
| 4,970,533 | 11/1990 | Saito | 347/86 X |
| 5,138,344 | 8/1992 | Ujita | 347/86 X |
| 5,168,291 | 12/1992 | Hiramatsu | 347/86 X |

FOREIGN PATENT DOCUMENTS

| | | | |
|---|---|---|---|
| 90060241 | 2/1991 | Australia | B41J 2/17 |
| 117718 | 9/1984 | European Pat. Off. | B41J 27/00 |
| 364284 | 4/1990 | European Pat. Off. | B41J 2/175 |
| 0412459 | 2/1991 | European Pat. Off. | B41J 2/175 |
| 54-56847 | 5/1979 | Japan | B41M 5/26 |
| 59-123670 | 7/1984 | Japan | B41J 3/04 |
| 59-138461 | 8/1984 | Japan | B41J 3/04 |
| 60-71260 | 4/1985 | Japan | B41J 3/04 |
| 61-180734 | 11/1986 | Japan | B41J 3/04 |
| 401075249 | 3/1989 | Japan | B41J 3/04 |
| 1-141750 | 6/1989 | Japan | B41J 3/04 |

*Primary Examiner*—Joseph W. Hartary
*Attorney, Agent, or Firm*—Fitzpatrick, Cella, Harper & Scinto

[57] ABSTRACT

An ink cartridge, including a casing, an ink container provided in the casing, an ink absorbing material provided in the casing, and an ink supply port in communication with the ink container to supply ink from the ink container to an outside of the case. An ink receiving port is provided in communication with the ink absorbing material and a projection from the casing adjacent the supply port prevents erroneous loading of the cartridge. The projection also allows an operator to quickly understand the inserting direction of the cartridge and allows the cartridge to be placed on a surface without ink from the cartridge contaminating the surface.

1 Claim, 10 Drawing Sheets

INK CARTRIDGE INCLUDING PROJECTION FOR PREVENTING ERRONEOUS LOADING

This application is a continuation of application Ser. No. 07/763,447 filed Sep. 20, 1991, which is now abandoned.

FIELD OF THE INVENTION AND RELATED ART

The present invention relates to an ink cartridge and an ink jet apparatus usable with the ink cartridge detachably mountable to the ink jet apparatus.

Various recording systems are known to effect recording on paper, an OHP (overhead projector) sheet, cloth or another recording material. The recording systems include a wire dot type, a heat-sensitive type, a heat transfer type, an ink jet type, for example. Among these systems, the ink jet type has recently been particularly noted because of its low running cost and quietness. In the ink jet recording system, an ink container (ink supply source) is made detachably mountable to the main assembly of the recording apparatus by manipulation of the operator to facilitate replenishment of the ink necessitated by consumption of the ink by the recording operation.

In this type of system, when the ink container is mounted into the main assembly of the recording apparatus, a hollow needle projected from the main assembly pierces a bag of the ink container to establish communication between the main assembly and the ink supply system. This necessitates provision of the hollow needle of the main assembly in the ink container setting position. Therefore, the needle is contaminated with the ink. Therefore, a cover is provided adjacent the ink container setting position to prevent the operators hand from direct access to the needle during the maintenance operation or the like. Means are provided to permit the cover to open only when the ink container is inserted. Actually, however, the cover is easily opened by the operator's hand contacting the latching portion. If the means is so constructed to provide difficulty in the opening, the structure is complicated with the result of higher cost and larger space.

The prior art will be described.

U.S. Pat. No. 4,074,284 issued on Feb. 14, 1978 discloses an ink supply system wherein a seal of the main assembly is pushed down by a leading side of the ink cartridge 12, and the ink cartridge is mounted into the main assembly. By doing so, a needle of the main assembly enters the ink cartridge 12, thus establishing communication between the ink bladder of the ink cartridge and the ink supply system of the main assembly. Then, the print head is supplied with the ink from the ink cartridge. This system involves the liability that the needle is easily exposed when the operator contacts the seal in the maintenance operation or the like. Japanese Laid-Open Utility Model Application No. 180734/1986 (Application No. 62973/1985) discloses an ink jet recording apparatus wherein a lack of the main assembly is moved by the leading edge of the ink cartridge 2, or the locking member of the main assembly is retracted by the leading edge of the ink cartridge 2 to release a movable member 13 or a bubble adjacent the ink cartridge inlet so as to permit loading of the ink cartridge to the main assembly. By doing so, the hollow needle of the main assembly enters the ink cartridge, so that the ink can be supplied. This system also involves the liability that when the operator contacts the lack or the locking member, the needle is easily exposed.

On the other hand, there is known ink cartridge prior art.

U.S. Pat. No. 4,119,034 issued on Oct. 10, 1978 discloses an ink supply reservoir which is detachably mountable to the main assembly and which comprises an integral flexible ink container and a residual ink collection chamber.

U.S. Pat. No. 4,695,824 issued on Sep. 22, 1987 discloses an ink storage apparatus which is detachably mountable to the main assembly and which comprises an integral flexible ink container and a residual ink absorbing material. The four edges of a face of the ink cassette case in communication with tubes are projected.

SUMMARY OF THE INVENTION

Accordingly, it is a principal object of the present invention to provide an ink cartridge and an ink jet recording apparatus usable with the ink cartridge, wherein the ink cartridge is advantageous in not requiring large space.

It is another object of the present invention to provide an ink cartridge and an ink jet recording apparatus usable with the ink cartridge having a projection on a face having an ink outlet portion.

It is another object of the present invention to provide an ink cartridge and an ink jet recording apparatus usable with the ink cartridge wherein a projection is provided for permitting retraction of a protection cover, when the ink cartridge is mounted into the main assembly of the recording apparatus.

It is a further object of the present invention to provide an ink cartridge and an ink jet recording apparatus usable with the ink cartridge wherein the ink cartridge has a projection for preventing the ink cartridge stably stand while its ink output portion being faced down.

It is a further object of the present invention to provide an ink cartridge and an ink jet recording apparatus usable with an ink cartridge wherein the ink cartridge has a projection for preventing the ink outlet portion from contacting a table when it stands or when it is caused to stand on the table.

It is yet a further object of the present invention to provide an ink cartridge and an ink jet recording apparatus usable with the ink cartridge of low cost.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Referring to the accompanying drawings the preferred embodiments of the present invention will be described.

Figure 1:
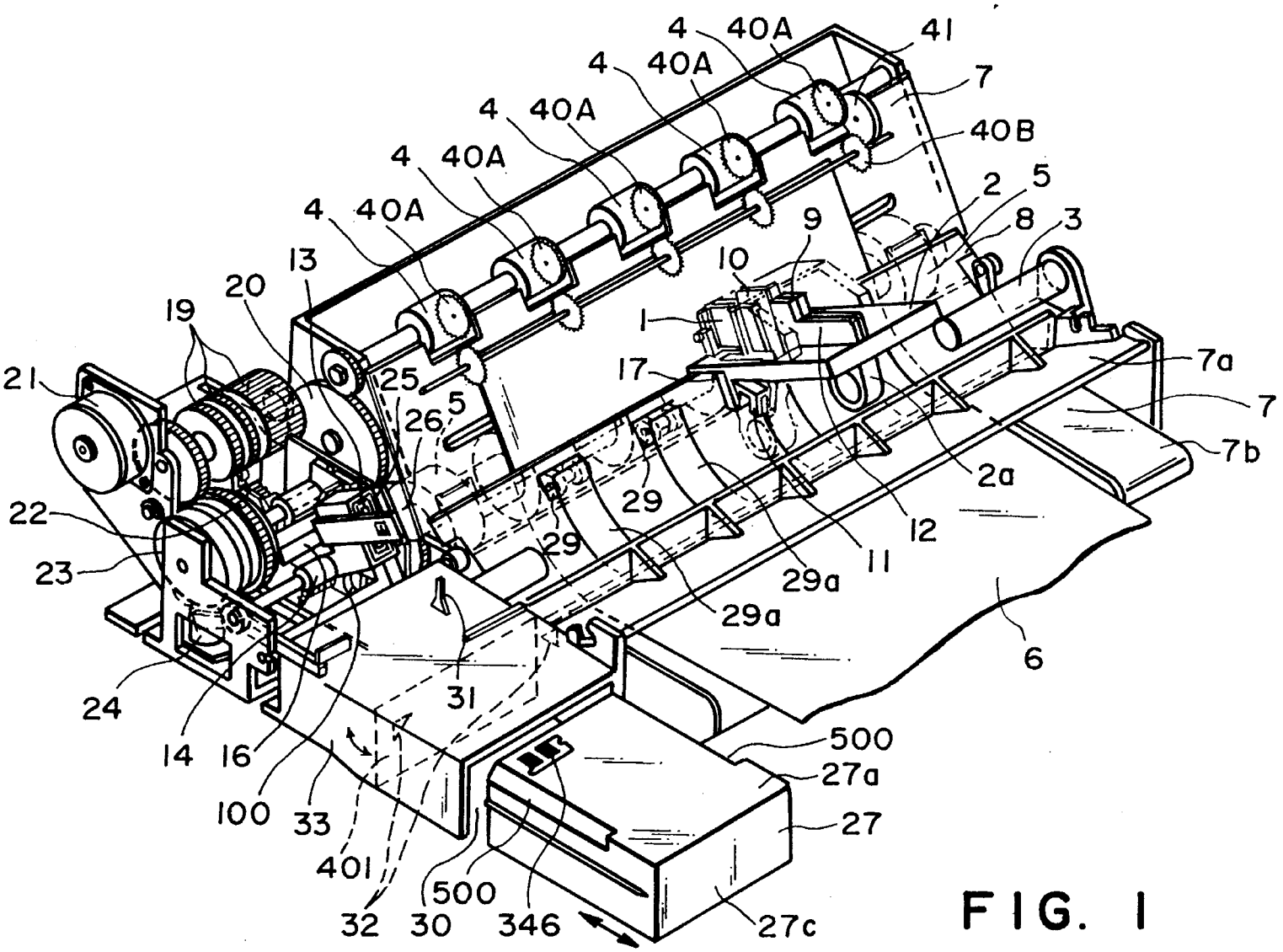
FIG. 1 is a perspective view of an ink jet recording apparatus according to an embodiment of the present invention without its top cover.

FIG. 1 is a perspective view of an ink jet recording apparatus according to an embodiment of the present invention wherein a cover of the apparatus has been removed. The ink jet recording apparatus comprises a recording head 1 in the form of a chip and a carriage 2 for mounting the recording head 1 thereon and for scanningly moving the recording head along a recording material (a sheet of paper). The carriage 2 is provided, as will be described in detail hereinafter, with a supporting member for detachably mounting the recording head 1 and a cover member (chain lines) for protecting a base plate which constitute a part of the recording head 1 and on which a head driver circuit or the like is printed.

The recording head 1 has 64 ejection outlets at its end surface, and the ejection outlets communicate with the respective ink passages. Behind the ink passages, a common liquid chamber is provided to supply the respective liquid passages with the ink. Each of the ink passages corresponds to each of 64 ejection outlets, an electrothermal transducer for generating thermal energy contributable to ejecting droplets of the ink through the ejection outlet and electrode wiring for supplying electric power to the electrothermal transducers.

The electrothermal transducer and the electrode wiring are formed on the base plate made of silicon or the like through film forming processes. By laminating partition walls and a top plate or the like made of resin or glass material, on the base plate, the ejection outlets, the ink passages and the common ink chambers are formed. Further behind on the recording head 1, a driving circuit is provided in the form of a printed circuit to drive the electrothermal transducers in accordance with the recording signals.

Figure 8A:
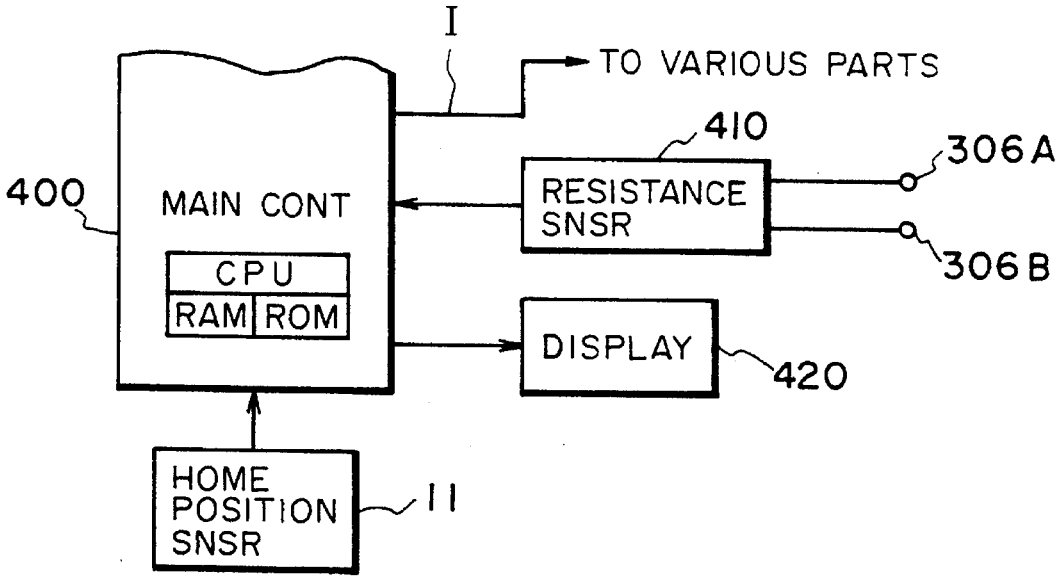
FIGS. 8A and 8B are a block diagram of a control system used with the structure of FIG. 7 and a flow chart showing the sequential operations thereof.

The carriage 2 is provided with a connector base 12 through a connector 9 at a position behind the recording head 1 mounting position. The connector base plate 12 is provided with a connector 9 for connection with the recording head 1 and a connector for connection with a flexible cable connected with a control circuit of a main assembly control system 400 (FIG. 8A). The connector base plate 12 has capacitors and resistors or the like which function to compensate voltage drop through the flexible cable and to prevent introduction of noise. The connector base plate 12 is supported on a sliding member, as will be described hereinafter and slides together with the opening and closing motion of the cover member so that the connector 9 is brought into contact with the contact of the recording head 1.

The carriage 2 is engaged with a guiding shaft 3 through the engaging portion 2*a* for sliding and rotational movement. The guiding shaft 3 extends over a range longer than the width of the recording sheet 6 in the direction perpendicular to the direction of the recording material feeding. The carriage 2 is connected with a part of a belt (not shown) stretched in a direction parallel with the guiding shaft 3. When the belt is driven by a carriage motor (not shown), the carriage 2 moves along the guiding shaft 3 in the scanning manner. The carriage 2 and the recording head 1 rotates along the guiding shaft 3 by the weights thereof. The weights are also effective to urge a sheet confining plate 8 which will be described hereinafter, through a sliding member 17 which is provided on the carriage 2 and slides on the sheet confining plate. Thus, the recording head 1 is spaced from the recording sheet 6 with a predetermined clearance therebetween irrespective of the thickness of the recording sheet 6.

The recording sheet 6 which is automatically fed out of a sheet feeding cassette (not shown) or manually fed out, is fed into the main assembly of the recording apparatus through a sheet inlet 7 constituted by an upper paper guide 7*a* and a lower paper guide 7*b*. The upper paper guide 7*a* has an extension constituting the curved sheet confining plate 8. The sheet confining plate 8 urges the recording sheet 6 to a platen roller 5. The material is so selected that the friction resulting between the sheet confining plate 8 and the recording sheet 6 under the urging force is smaller than the friction between the sheet feeding roller 5 and the recording sheet 6. The lower paper guide 7*b* extends to a position where the sheet confining plate 8 is in parallel with the platen roller 5.

The recording sheet 6 is supplied through the sheet inlet 7 and is fed upwardly together with the rotation of the sheet feeding roller 28 line-by-line. At this time, the recording sheet 6 slides on a plate-like platen 7 while the interval between the recording head 1 and the recording sheet 6 is maintained at a predetermined level by the sheet confining plate 8 and the platen 7. A pinch roller 29 is pressed on a periphery of the sheet feeding roller 5 by the resiliency of a leaf spring 29*a*.

The recording head 1, during its scanning movement, ejects or discharges ink droplets to the recording zone of the recording sheet faced thereto, thus effecting the recording operation for one line. By repeating the recording operation and the subsequent sheet feeding operation by one line, character, the characters, the images or the like are recorded. The recording sheet 6 now having the recorded image or the like is discharged onto the discharge tray (not shown) by discharging roller 4 and spurs 40A and 40B disposed above the sheet conveying passage. Five pairs of spurs 40A and 40B are provided for five pairs of discharging rollers 4. Between the spurs, a spur cleaner is disposed. In FIG. 1, the member for supporting the spur cleaner and the spur cleaner are omitted. The spur 40A presses the recording sheet 6 to the discharging roller 4, and the spur 40B confines the conveying direction of the recording sheet 6 in cooperation with the platen 7. The discharging roller 4 is rotated so as to have a peripheral speed larger than that of the sheet feeding roller 5, so that the recording zone of the recording sheet 6 is stretched upwardly, by which the recording sheet 6 is prevented from being away from the platen 7, thus assuring the proper recording operation in the recording zone.

Adjacent a home position which is continuous with the scanning zone of the recording head 1, various structures for effecting ejection recovery for the recording head 1 are provided. The structure includes a blade 26 for removing droplets, dust or the like on the ejection side surface having the ejection outlets by a wiping action, an absorbing member 25 for removing the droplets on the ejection side surface by absorption, and a cap for capping the ejection side surface to seal the ejection side surface, effecting idle ink ejection and sucking the ink. They are supported integrally on a supporting member 14 which is movable toward and away from the recording head 1 moving zone, so as to carry out the respective operations at proper times. The ink sucking operation using the cap 13 is carried out with a pump 24 which is communicating with the gap 13 through a hollow portion of the movable supporting member 14 and a tube. When the recording head is capped by the cap 13, a hole formed in a cap arm 17 mounted on a side surface of the cap supporting member is engaged with a projection of the carriage 2 so that the recording head 1 is prevented from backward rotation, thus assuring the capping of the cap 13 for the ejection side surface.

The rotational driving force of the feed motor 21 is used to rotate the sheet feeding roller 5, the discharging roller 4 and operates the ejection recovery mechanism, more particularly, the movement of the cap 13, the blade 26 and the absorbing member 25 and the pump 24. The rotational driving force of the feed motor 21 mounted on the frame of the main assembly is first transmitted to a transmission and switching gear train 19. In the gear train 19, the selective switching is effected by movement of an unshown selecting gear operable in association with the scanning movement of the recording head 1, the movement to the home position or the ejection recovery position and the stoppage thereat. The rotations of the gears in the gear train 19 is transmitted to the sheet discharging roller 4 and the sheet feeding roller 5 via an intermediate gear 20. It is also transmitted to the integral cap 13 or the like by way of a cam 16 and also transmitted to the pump 24 via pump gear 22 and a pump cam 23.

The ink is supplied to the recording head 1 from the ink cartridge 27 mounted on the main assembly of the recording apparatus through a flexible tube 100 (FIGS. 1, 2 and 4) which can follow the movement of the carriage 2. More particularly, the ink is supplied to the recording head I from the ink cartridge 27 through a tube 100 connecting the hollow needle 314 and the recording head 1. The position of the carriage 2 is detected by counting the number of steps actuated by the carriage motor (not shown) with the reference position provided by interrelation between a home position sensor 11 of the carriage 2 and a home position detecting flag 31 adjacent an end of the moving zone of the carriage 2. These operations are controlled by the controller 400 (FIG. 8A) of the main assembly.

The description will be described as to the mounting portion 30 to which the ink cartridge 27 is mounted, and also the description will be made as to the ink cartridge.

Figure 2A:
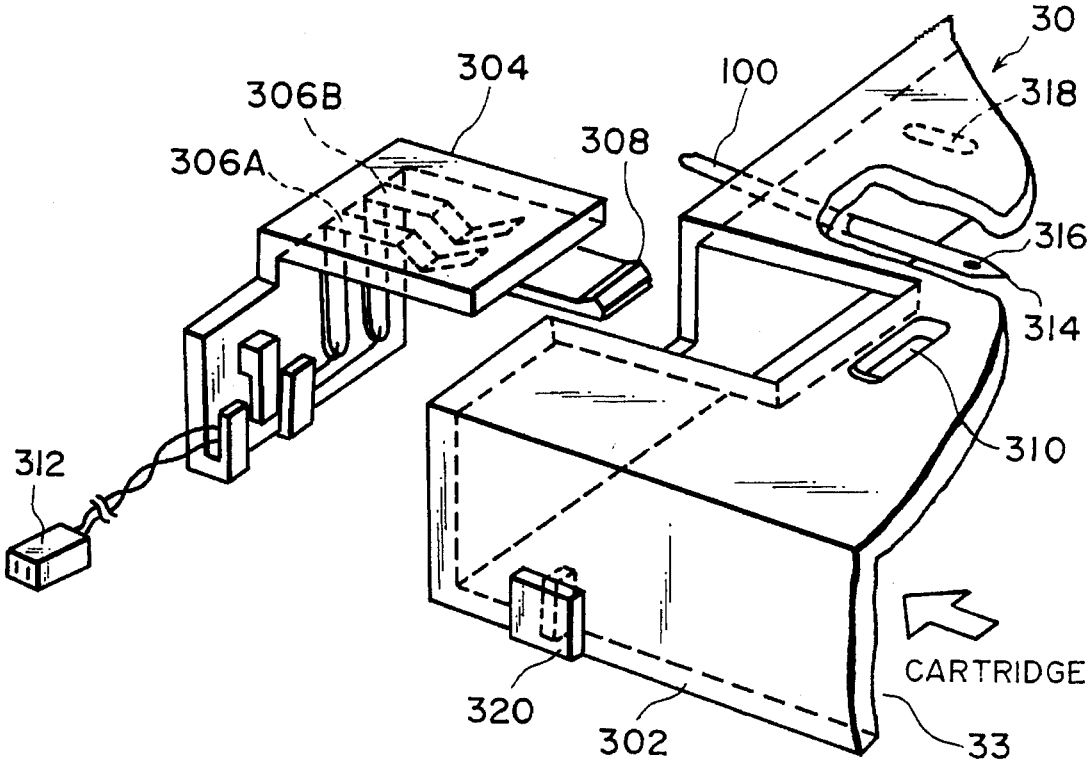
FIGS. 2A and 2B are a perspective and a partial sectional view of a structure of an ink cartridge mounting portion of the ink jet recording apparatus.
Figure 2B:
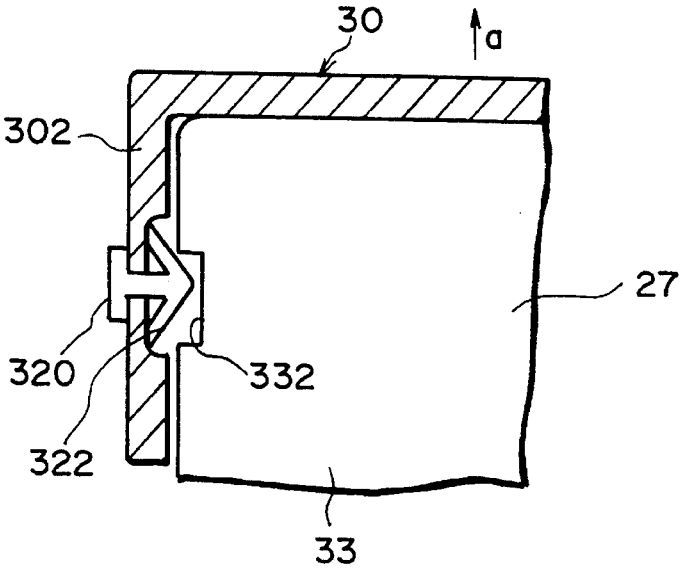

FIGS. 2A and 2B show the mounting portion 30 for the ink cartridge. In FIG. 2A, designated by a reference numeral 302 is an ink cartridge inserting portion for receiving the ink cartridge 27. A contact holder 304 functions to hold leaf spring contacts 306A and 306B functioning as a means for reading information provided on the ink cartridge 27. By engagement between a latching portion 308 and the inserting portion 302, it is combined into the inserting portion 302. FIG. 2A shows the state before the holder 304 is combined with the inserting portion 302. A connector 312 functions to connect the contacts 306*a* and 306*b* with the controller 400 of the main assembly.

A hollow needle 314 pierces in an ink containing bladder and has three holes 316 for receiving the ink, at its end. To the other end of the needle 314, an ink supply tube 100 is connected, and the other end of the tube 100 is connected to the common ink chamber in the head chip 110 of the recording head 1. An ink remaining amount detecting means may be disposed at a proper part in the ink supply system.

A residual ink receiving pipe 318 enters the ink cartridge 27 through an opening 350 (FIG. 4) and feeds the residual ink to the ink absorbing material 344. The residual ink is produced by the refreshing process from the ink supply system or the common ink chamber or by the ink ejection recovery processing.

A click 320 functions to fix the ink cartridge 27, and it is provided at each side of the inserting portion 302. As shown in FIG. 2B, an engaging portion 322 of the click 320 flexes by its flexibility upon engagement with the side surface of the cartridge 27 when it is inserted, so that the insertion of the cartridge 27 is permitted. When a recess 322 of the cartridge 27 reaches the position where the click 320 is disposed, the engaging portion 322 restores by its elasticity, by which the click 320 engages into the recess 322. Thus, the cartridge 27 is fixed in place.

Figure 3:
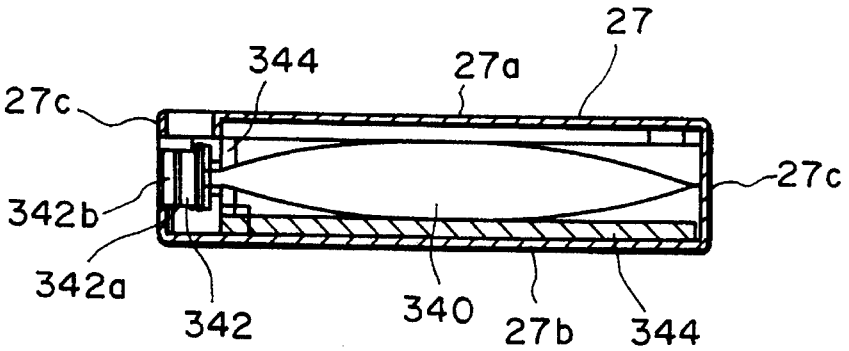
FIG. 3 is a sectional view of an ink cartridge according to an embodiment of the present invention.
Figure 4:
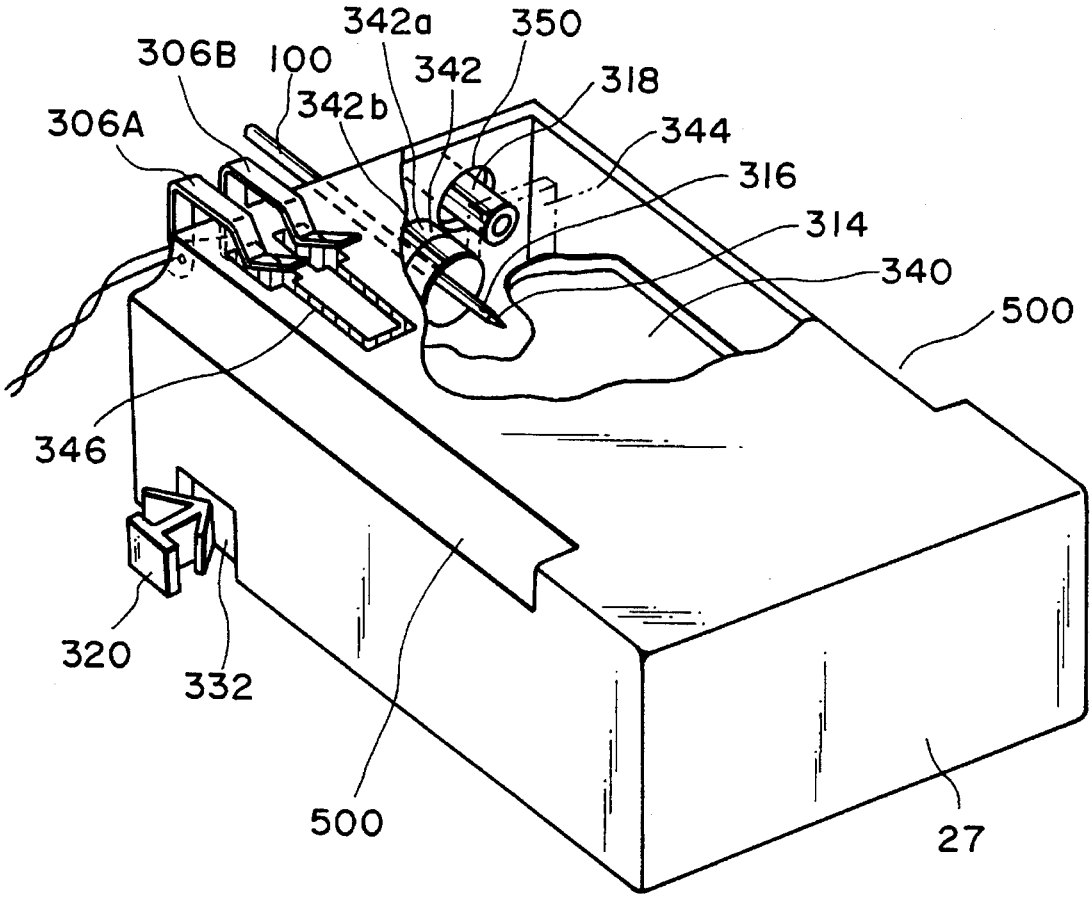
FIG. 4 is a perspective view illustrating interconnection between the ink cartridge and the main assembly of the recording apparatus.

Referring to FIGS. 3 and 4, the ink cartridge 27 will be described.

It comprises a flexible ink bladder 340 for containing the supply of the ink and is provided with a plug 342 made of rubber or the like. The ink bladder 340 is hermetically sealed by the plug 342. When the ink cartridge 27 is mounted into the mounting portion 30 of the main assembly, the needle 314 of the main assembly pierces into the plug 342 to a sufficient degree, by which the ink communication is established. An annular ring 342*b* protects the rubber plug 342. The ink cartridge 27 also comprises an ink absorbing material 344 for absorbing the residual ink. The ink absorbing material 344 is disposed between the ink bladder 340 and the bottom surface 27*b* of the case 27*a* of the cartridge 27 so as to cover substantially the entire bottom surface 27*b*. As shown in FIG. 4, a part thereof extends substantially vertically at the rear side of the opening 305. Thus, the ink introduced from the main assembly through the residual ink pipe 318 is assuredly distributed over substantially the entirety of the bottom surface 27*b*.

FIG. 4 illustrates the connection between the ink cartridge 27 and the main assembly. A wiring pattern 346 on the ink cartridge 27 functions to connect the contacts 306A and 306B. By the electric connection or non-connection between the contact 306A and 306B, the controller 400 of the main assembly detects whether the ink cartridge 27 is mounted or not. The pattern may have a resistance depending on the color or density or the like of the ink stored in the ink cartridge 27. Then, the controller 400 is also informed of the characteristics.

When the ink cartridge 27 is inserted into the main assembly of the recording apparatus, it passes by an inserting position (1) where the ink communication is established by the insertion of the needle 314 through the plug 342 to place the holes 316 in the ink bladder 340, an inserting position (2) wherein the contacts 306A and 306B are connected by the wiring pattern 346 with each other, and an inserting position (3) in which the click 320 is in engagement with the recess 332 to fix the ink cartridge 27. Various dimensions and positional relations are determined so that the inserting positions come in this order. When the operator inserts the cartridge 27 into the apparatus, the needle 314 first pierces the ink bladder 340. When the cartridge 27 is further inserted into the main assembly, the contacts 306A and 306B are brought into electric contact through the resistance pattern 346. When the cartridge 27 is further inserted, the click 320 is brought into engagement with the recess 332, so that the cartridge 27 is fixed in place in the mounting portion 30 in the main assembly. In this embodiment, the ink cartridge 27 accommodates the residual ink, and therefore, it is desirable that the residual ink pipe 318 is brought into the ink cartridge 27 at the inserting position (1).

Figure 5:
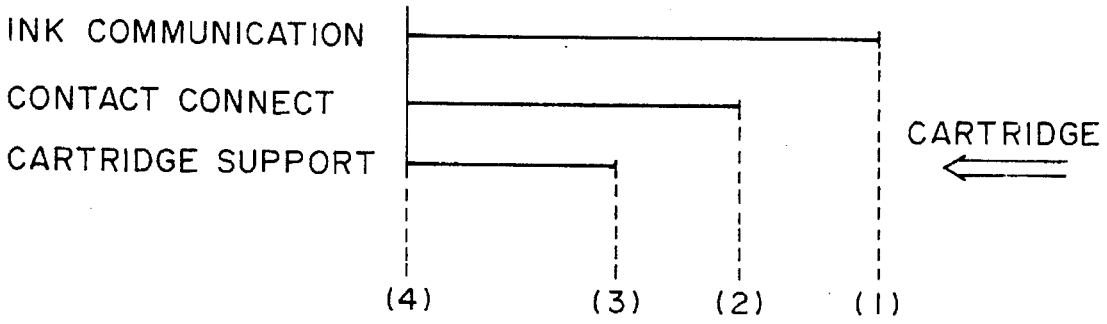
FIG. 5 illustrates the positional relation of the connection.

FIG. 5 shows the above-described positional relations. In FIG. 5, the ink cartridge 27 finally abuts the part of the main assembly at the inserting position (4). Therefore, the range between the position (3) and position (4), is the movable range in which the cartridge 24 is movable by the play of the engagement between the click 320 and the recess 332, or the range through which the cartridge 27 is movable after the engagement between the click 320 and the recess 332 and until its abut the back end of the main assembly.

Figure 6:
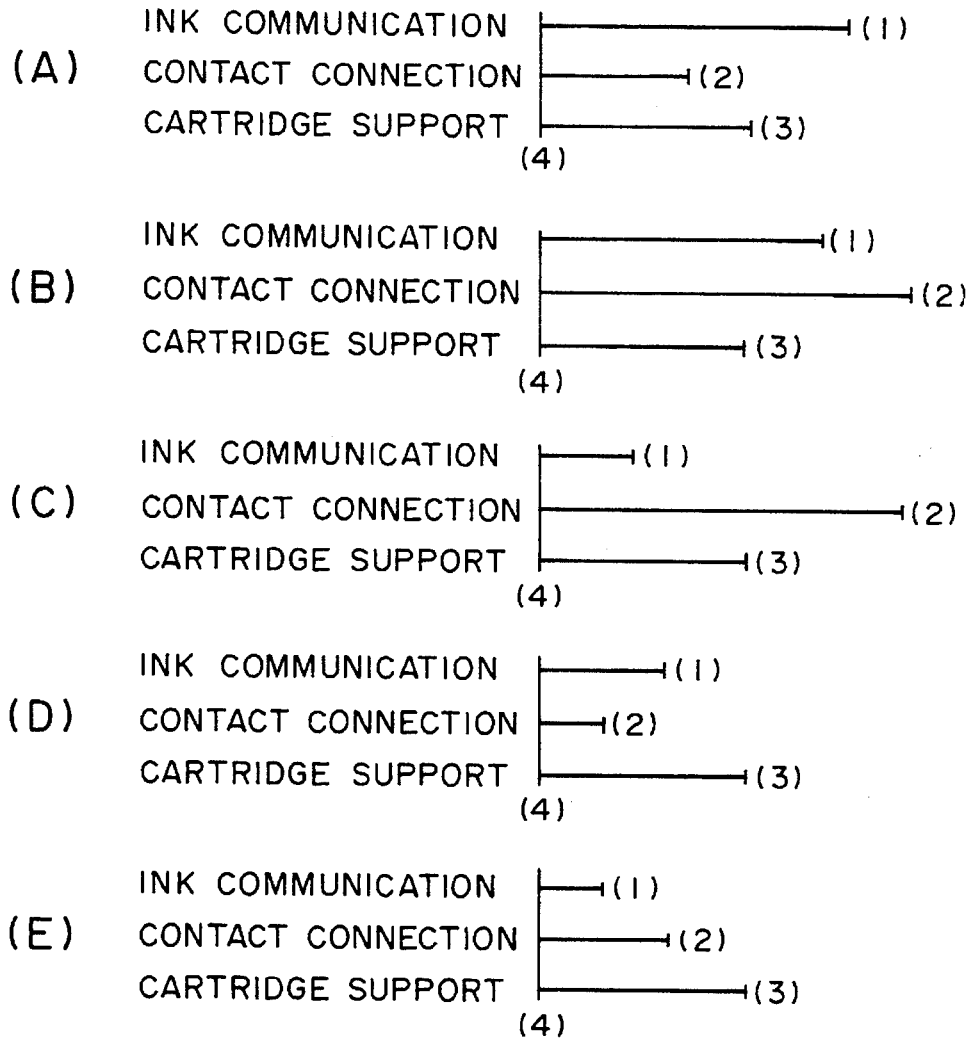
FIG. 6A–E illustrate inconveniences arising when the positional relation in this embodiment is not used.

FIG. 6 illustrates the inconveniences when the above positional relations are not satisfied. In the positional relation shown in FIG. 6A, even if the cartridge is properly fixed, the information on the characteristics of the cartridge is not read by the contact 306A and 306B, and therefore, the controller 400 of the main assembly does not correctly discriminate the insertion of the ink cartridge. With the positional relation shown in FIG. 6B, the contacts are established prior to the communication of the ink established. The controller 400 will erroneously discriminate the completion of the cartridge insertion and can start a certain operation. If this occurs, the air may be introduced into the ink supply system by the needle 314. This also applies to the case of FIG. 6C. In addition, if the operator stops the inserting operation because of the clicking sound produced, the ink communication is not established.

With the positional relations shown in FIGS. 6D and 6E, the needle 314 is not correctly inserted even though the cartridge is properly fixed. Or, the electric connection between the contacts will not be stabilized.

If the positional relations shown in FIG. 5 are used, the ink communication, the electric connection between the contacts and the cartridge fixing occur in this order when the cartridge is inserted. Therefore, what is required for the operator is to confirm the cartridge fixing on the basis of the click sound. Even if the controller 400 starts the operation immediately in response to the establishment of the electric connection, no air is introduced into the ink supply system. In addition, even if the cartridge 27 is removed during the operation of the controller 400, the controller 400 is able to detect the event before the ink communication is destroyed. Therefore, no inconveniences arise if the operation is stopped in response thereto.

Figure 7A:
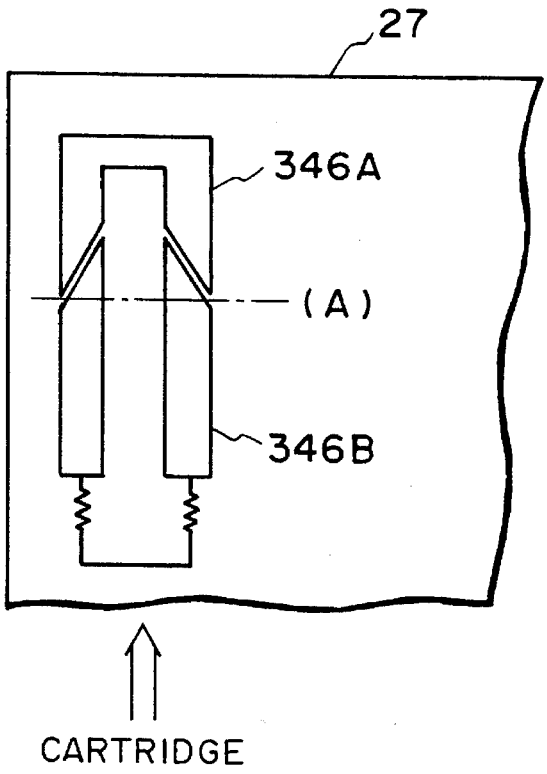
FIGS. 7A and 7B are partial enlarged views of an ink cartridge and the positional relation in an improved modification of FIGS. 4 and 5 arrangement.

FIG. 7A shows a structure of a further improved apparatus. In this embodiment, the wiring pattern is divided into two parts. The front pattern 346A with respect to the cartridge inserting direction is allotted the function of establishing electric connection between the contact 306A and 306B, and the rear pattern 346B is allotted the function of representing ink color and density or the like by changing the resistance.

Figure 7B:
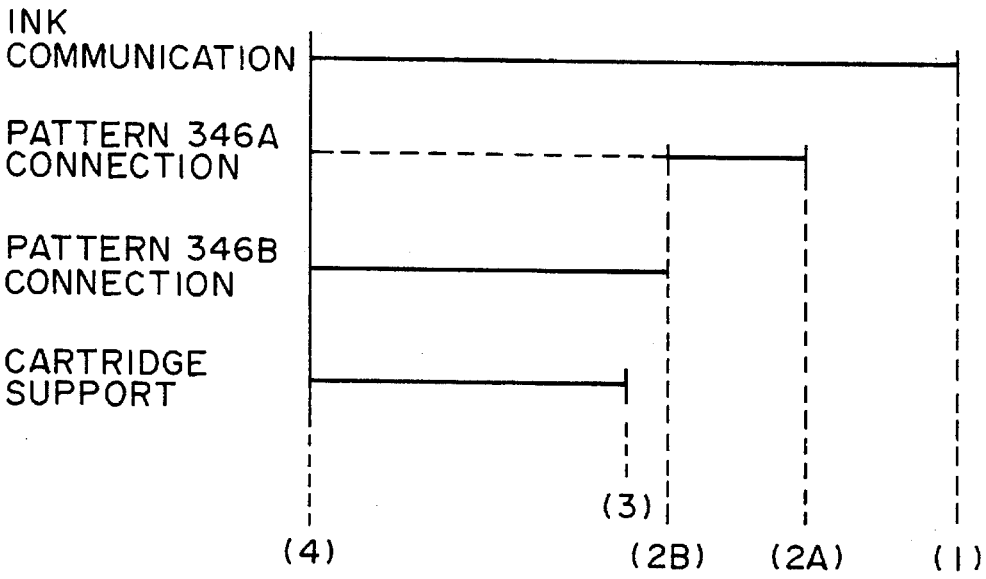

FIG. 7B shows a range in which the ink communication is established, a range in which the electric connection is established between the contact 306A and 306B through the pattern 346A, a range in which they are contacted only through the pattern 346B, and a range in which the cartridge is properly fixed.

A position (1) is a limit position for the ink communication, a position (3) is a limit position for fixing the cartridge 27, and a position (4) is a cartridge 27 abutment position. A position (2A) is a trailing side limit position (with respect to the cartridge inserting direction) for the electric connection between the contact 306A and 306B through the pattern 346A. A position (2B) is a trailing limit position in which the contact 306A and 306B are away from the pattern 346A, and they are contacted only with the pattern 346B so that the resistance of the pattern 346B is readable. Here, the position (2B) is preferably the same as or in the neighborhood of the position (3), and particularly in the neighborhood of the position (3) where the click 320 is not engaged with the recess 332, and therefore, the cartridge 27 is easily retracted.

Because of the positional relations shown in FIG. 7B, the same advantageous effects as in the case of FIG. 5 are provided. With this embodiment, the further advantages are provided when the following operation is carried out.

FIG. 8A shows the major part of the control system. It comprises a controller 400. It may be in the form of a microcomputer comprising a CPU for controlling the process shown in FIG. 8B and for controlling the entirety of the apparatus, ROM storing the program or the like for the process and working RAM. Designated by a reference numeral 410 is a detector for detecting the resistance between the contacts 306A and 306B. When the resistance is zero, it indicates that the pattern 346A short-circuits the contacts. If it is the infinity, it indicates that the ink cartridge 27 is not mounted. When the resistance has a predetermined level, the fact indicates that the ink cartridge 27 is properly mounted in place in the mounting portion 30. Designated by a reference numeral 420 is an information part having a display for a message and/or sound producing means. Reference I designates stopping signal for various parts.

Figure 8B:
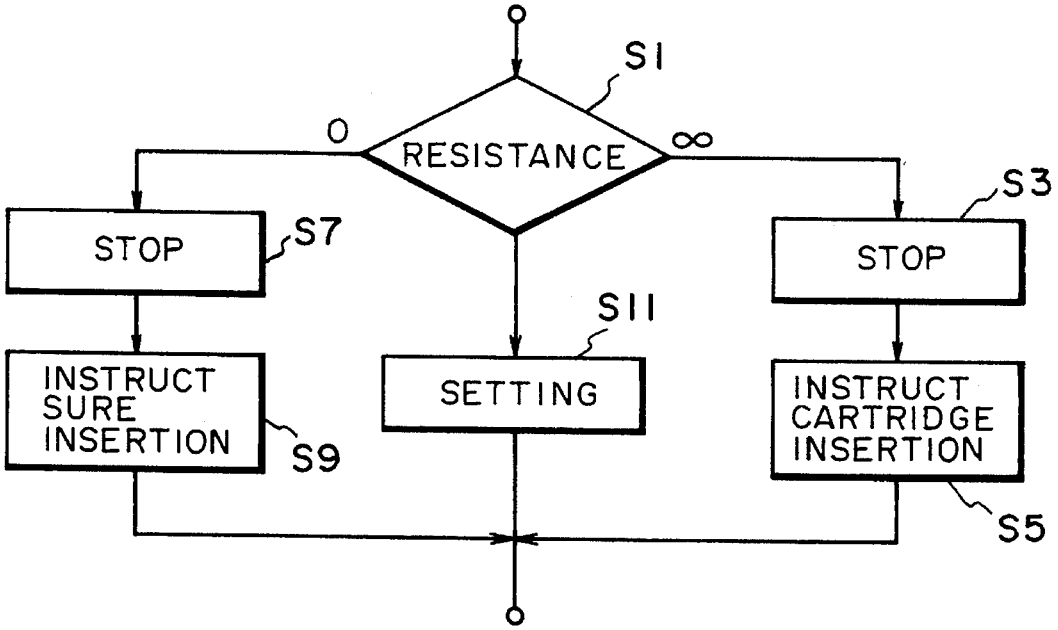

FIG. 8B shows an example of the operational steps of this embodiment. This operation may be started when the main switch is actuated, when the ink cartridge 27 is exchanged or at proper timing during the recording.

When the process is started, the resistance is read at step S1. If it is the infinity, it is discriminated that the cartridge 27 is not mounted. Therefore, the operation proceeds to step S3 where the operations of various parts are maintained at rest. At step S5, the operator is prompted to insert the cartridge 27 into the recording apparatus.

If the resistance is zero, it is discriminated that the cartridge 27 is easily retracted. Therefore, the operation proceeds to step S7, where the operations of various parts are stopped. Subsequently, at step S9, the operator is promoted to assuredly set the cartridge 27.

If the resistance has a predetermined level, the cartridge 27 has already been assuredly fixed. The information (ink color or the like) of the cartridge, indicated by the resistance, is read, and the setting operations corresponding to the information are carried out at step S11.

If the click 320 and the recess 332 are not engaged despite the operator inserting the cartridge 27 into the apparatus, or when the engagement is released for some reason or another, the retention of the cartridge is not sufficient, therefore, the cartridge is easily released. On such an occasion, the contact 306A and 306B are electrically connected by the pattern 346A, and therefore, the controller 400 is unable to read the information inherent to the cartridge 27. In this embodiment, the controller 400 is capable of recognizing such a situation, and stops the operation, and thereafter, the proper insertion of the cartridge 27 is prompted to the operator. In this manner, the liability that the cartridge 27 is released against intention can be notified to the operator beforehand.

In this embodiment, the cartridge and the inserting position may have another structure if the above described positional relations relating to the ink communication, the cartridge information reading and the cartridge retention, are assured. For example, the retention of the cartridge is not limited to that by the click and the recess structure. The leading of the information inherent to the ink cartridge is not limited to the electric one. It may be an optical one. In the foregoing embodiment, the residual ink is introduced into the cartridge, but the cartridge may have only the function of ink supply.

In this embodiment, a cover 401 is provided at the inlet portion of the inserting or mounting portion 30 so as to prevent the operator's finger or other foreign matter from contacting the ink receiving needle 314 in the maintenance operation or the like. The cover 401 is prevented from opening except for the cartridge 27 insertion time.

Figure 9:
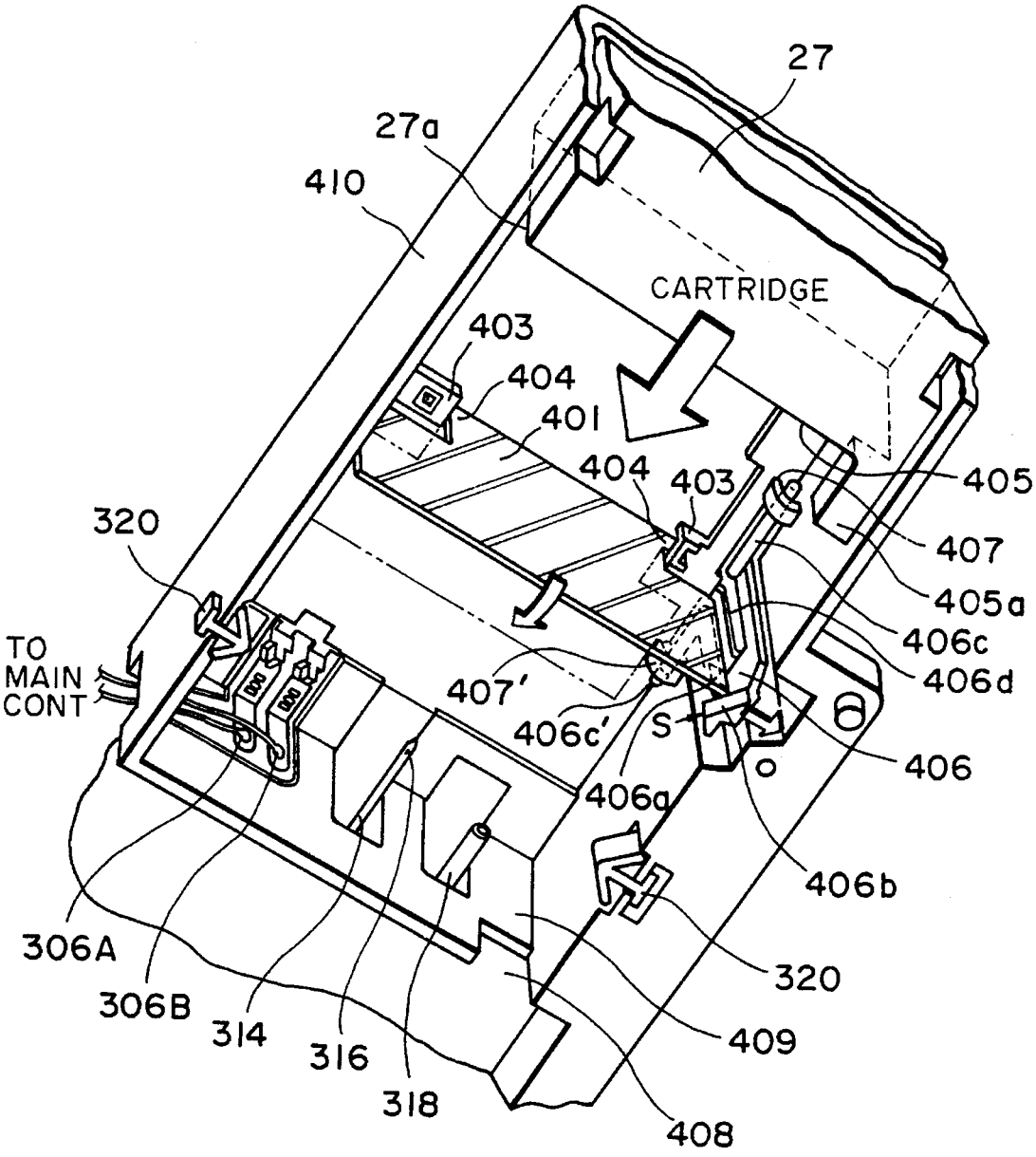
FIG. 9 is a bottom view of the ink cartridge inserting portion.
Figure 10A:
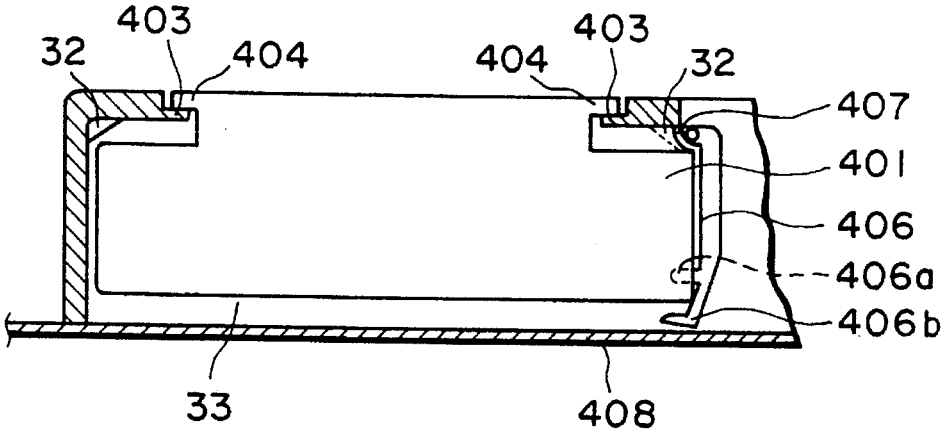
FIGS. 10A, 10B and 11 are sectional views of an ink cartridge inserting portion.
Figure 10B:
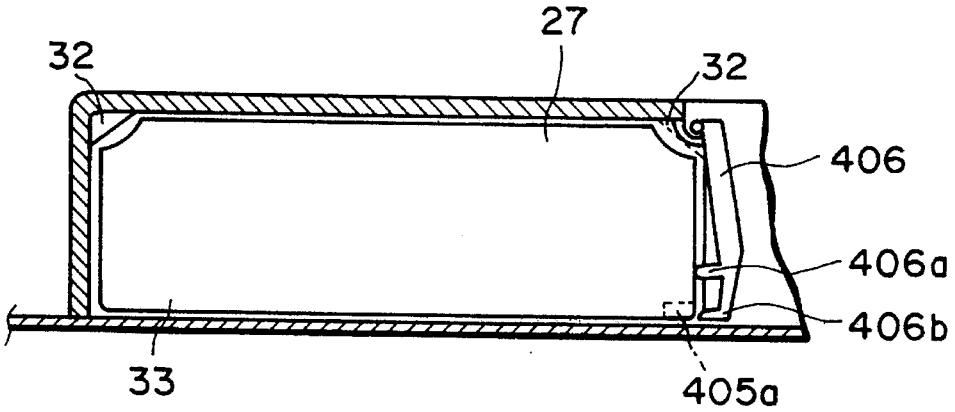
Figure 11:
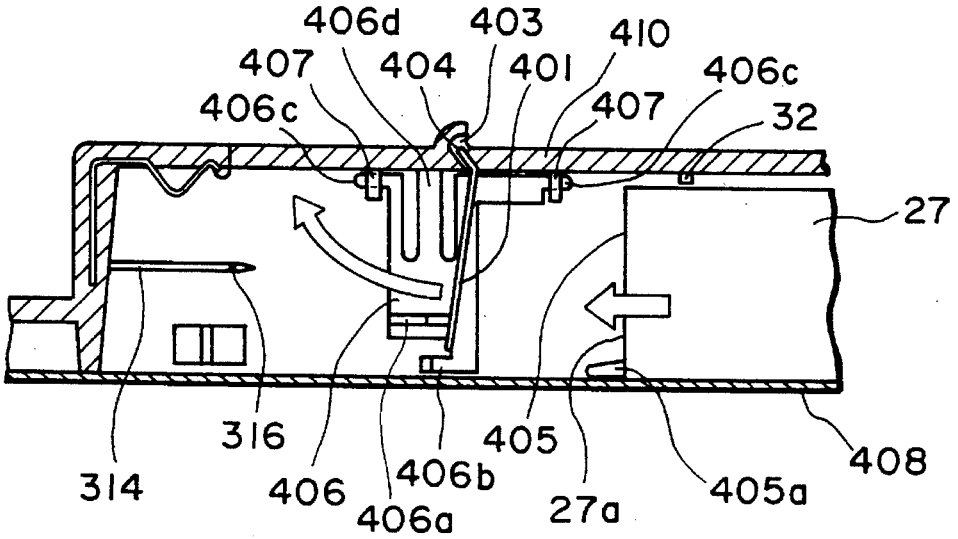

Referring to FIGS. 9–11, the structure will be described. FIG. 9 is a bottom view of the inserting portion and corresponds to the view taken along lines a in FIG. 2. FIG. 10 is a sectional view taken along a line vertical to the ink cartridge inserting direction. FIG. 10A shows the situation when the ink cartridge 27 is not mounted, and FIG. 10B shows the situation when it is mounted. FIG. 11 is a sectional view taken along a line parallel with the ink cartridge inserting direction.

The cover 401 is disposed so as to block the cartridge inserting path and is made of a metal plate having a thickness of 0.8 mm, for example. It has an area substantially equal to the sectional area of the ink cartridge. Therefore, when the cartridge inserting path 33 is blocked by the cover 401, it does not provide enough space for permitting insertion of the operator's finger or other foreign matters beyond the cover 401. Therefore, the needle 314 and/or the residual ink pipe 318 are protected from them. The cover 401 is rotatable about a recess 403 in the sealing of the mounting portion 30 with which a hook 404 of the cover.

When the cartridge 27 is inserted, the cover 401 is urged upwardly by the insertion of the cartridge 27 and rotates about the recess 403 until it is contacted to the sealing to permit the insertion of the cartridge 27. When the cartridge 27 is not in the inserting portion, a pawl 406*a* of a stopper 406 is projected into the rotational movement range of the cover 401, so that the cover 401 is prevented from opening by the pawl 406*a*. Thus, the cover 401 blocks the cartridge insertion path 33 and also prevents the introduction of foreign matters beyond the cover 401. Further below the pawl 406*a* of the stopper 406, there is an inclined portion 406*b* below a bottom end of the cover 401.

When the cover 401 is at the closing position, the top portion S of the tapered portion 406*b* is further inside of the cover 401. Therefore, the tapered portion 406*b* is kept from the operator's finger or the like. The stopper 406 has a pin 406*c* at its upper position, and the pin 406*c* is supported in a bearing 407 of the mounting portion. An upper end of a spring 406*d* integral with the stopper 406 is engaged with a frame 410 of the main assembly so as to urge the stopper 406 to the cartridge mounting portion. When a projection 405*a* of the cartridge 27 pushes the tapered portion 406*b*, the stopper 406*b* rotates in the retracting direction from the cartridge insertion path 33 about the pin 406*c* against the spring force by the spring 406*d*, by which the pawl 406*a* is released from the cover 401, thus permitting opening of the cover 401. In other words, the cover 401 is permitted to retract from the cartridge insertion path 33. The cartridge 27 has a projection 405*a* on a front surface 405 (leading side with respect to the cartridge inserting direction) at a position corresponding to the tapered portion 406*b* of the stopper 406 upon insertion of the cartridge.

When the cartridge 27 is inserted into the inserting path 33, the projection 405*a* is faced to the tapered portion 406*b*. Therefore, when the cartridge is in the process of being inserted, the projection 405*a* enters the gap between the cover 401 and the frame 408 beyond the cover 401 until it contacts the tapered portion 406*b* of the stopper 406. When the cartridge 405 is further inserted, the projection 405 lowers the tapered portion 406*b* so as to retract the tapered portion 406*b* away from the insertion path 33, until the pawl 406*a* of the stopper 406 is released from the cover 401. Then, the cover 401 is permitted to retract away from the insertion path, thus permitting further insertion of the cartridge 27. Thereafter, the front side 405 of the cartridge 27 abuts directly the cover 406, by which the cover 401 is raised by the cartridge 27.

The relations between the projection 405*a* of the cartridge 27 and the front side 405 of the cartridge and between the cover 401 and the stopper 406, are as follows:

(1) The projection 406*a* lowers the tapered surface 406*b* of the stopper 406;

(2) The pawl 406*a* of the stopper is released from the cover 401; and (3) The front side 405 of the cartridge 27 raises the cover 401.

Then, as described hereinbefore, the needle 314 and the residual ink pipe 318 are introduced through the plug 342 and the opening 350 of the cartridge 27. Then, the ink communication is established, and the presence of the cartridge is detected, with the cartridge prepared for receiving the residual ink. In addition, the cartridge 27 is fixed or retained in place in the mounting portion 30 by the engagement between the click 320 and the cartridge recess 332.

The inside plate 409 of the mounting portion is provided with a hole 408 (FIG. 9) for receiving the projection 405*a* of the cartridge. As described hereinbefore, the stopper 406 is normally urged in the direction of locking the cover 401 by the contact of the spring 406*d* to a part of the main assembly.

In this embodiment, the clearance between the cover 401 and the frame 408 is approximately 4 mm when the cover 401 is at its closing position, and the top S of the tapered surface 406*b* of the stopper 406 is at a position approximately 3 mm away from the cover 401 toward the inside. The height of the projection 405*a* of the cartridge 27 is approximately 2 mm from the bottom surface, and the length thereof is approximately 2 mm. With these sizes, it is not possible to release the stopper 406 by the operator's finger without intention. Therefore, the cover 401 is not unintentionally opened during in the maintenance operation or the like.

The projection of the cartridge and the latching of the main assembly is not limitedly provided to the lower side, but it may be disposed at the lateral side or the like, as required by the structure of the main assembly. They may be provided at the opposite sides.

Figure 12:
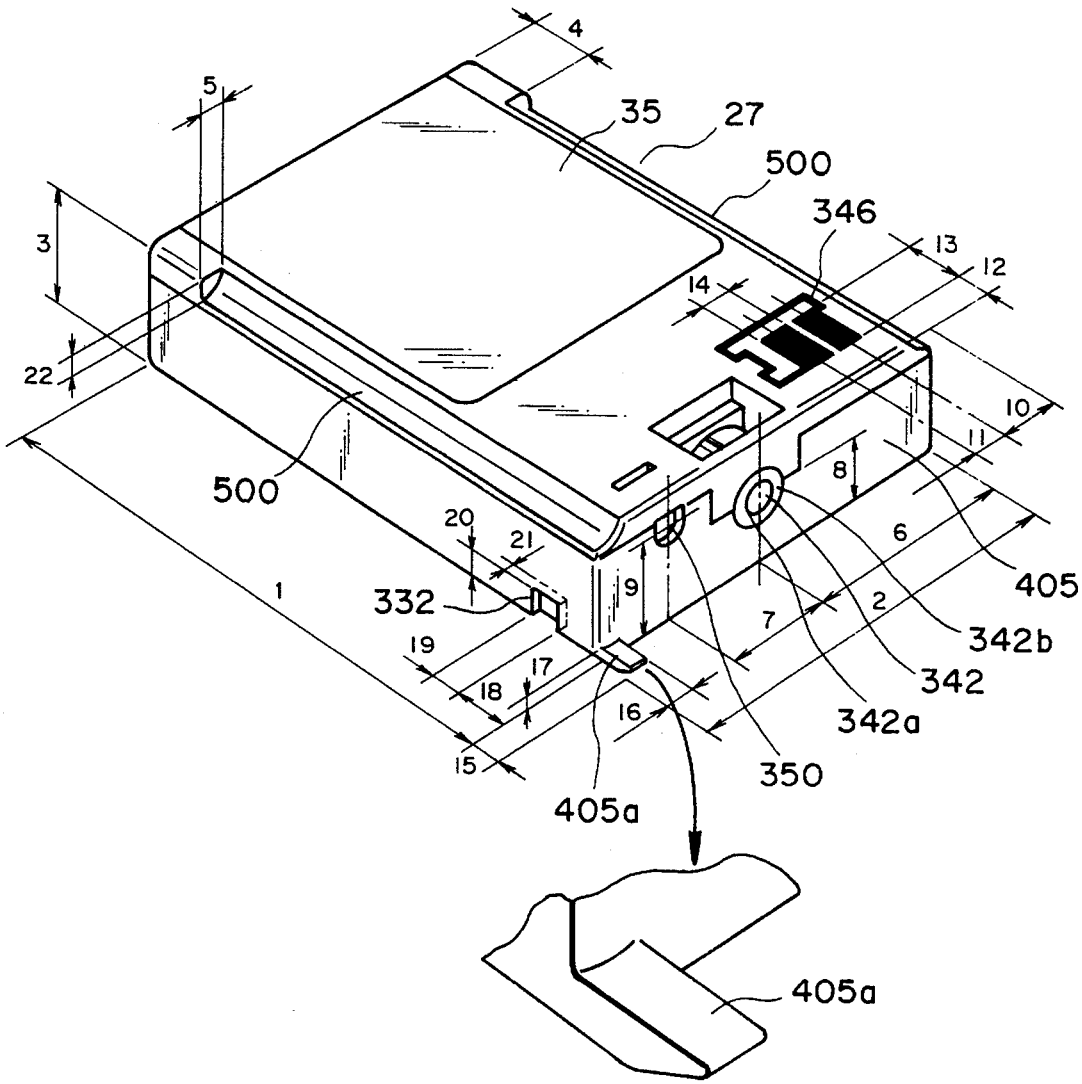
FIG. 12 is a perspective view of an ink cartridge.
Figure 13:
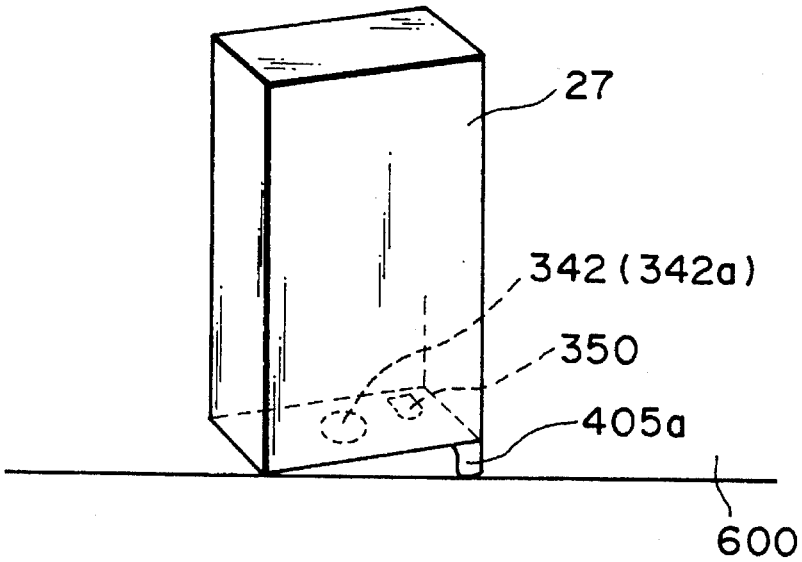
FIG. 13 shows an ink cartridge wherein it stands on a table.
Figure 14:
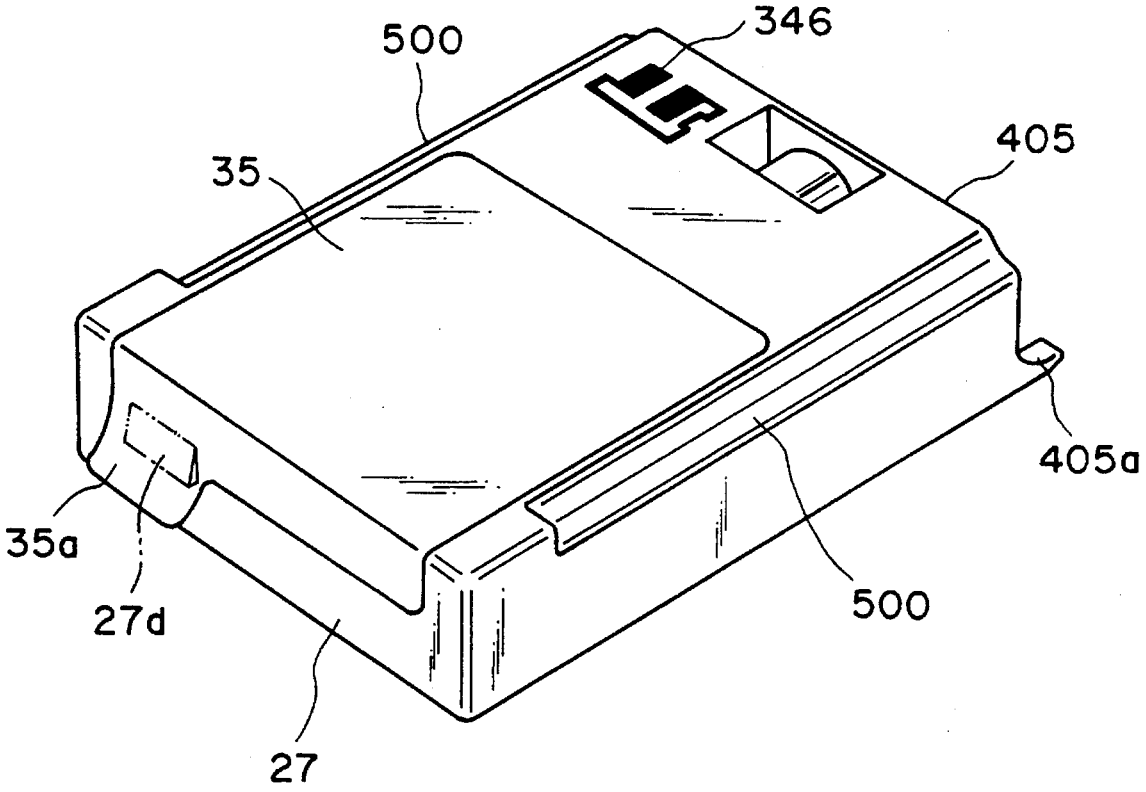
FIG. 14 is a perspective view of an ink cartridge having a pulling seal.

Referring to FIG. 12, the dimensions of the ink jet cartridge 27 are as follows: 1: 109 mm: 2; 79.6 mm: 3; 25.5 mm: 4:14 mm: 5; 6 mm: 6; 42.8 mm: 7; 20.8 mm: 8; 12.5 mm: 9; 17.5 mm: 10; 13.4 mm: 11; 7 mm: 12; 6 mm: 13; 12 mm: 14 and 15; 6 mm: 16; 4 mm: 17; 2.5 mm: 18; 10 mm: 19 and 20; 6 mm: 21; 2 mm: 22; 4.5 mm: 23; 3 mm:

An inclined surface 500 at each of the left and right top of the cartridge 27 is provided for preventing erroneous insertion.

More particularly, when the operator erroneously tries to insert the cartridge 27 up-side-down into the mounting or inserting portion 30, the top 27*c* (FIG. 3) of the leading side of the cartridge case 27*a* abuts the limiting plate 32 of the main assembly (FIGS. 1, 10A and 10B), so that the loading of the cartridge 27 is prevented. When the cartridge 27 is correctly inserted, the inclined surface 500 is effective to escape from the limiting plate 32, so that the cartridge 27 is permitted to be further inserted. The configuration at the top end of the cartridge case 27*a* is not limited to the inclined or tapered surface but may be changed in accordance with the shape of the limiting plate.

As shown in FIG. 12, a pulling seal 35 is bonded on the top of the ink cartridge 27. The seal 35 is bent and is extended to the rear side 27*c* of the cartridge case 27*a*. An end thereof constitutes a tongue 35*a* covering a projection 27*d* on the rear side 27*c*. When the cartridge 27 is to be taken out of the main assembly, the tongue 35*a* is peeled off the case 27*a*, and the cartridge is pulled out by the pulling seal 35*a*.

The ink cartridge in this embodiment is provided with the projection 405*a* at the side having the plug 342 and/or the opening 350. Therefore, the following advantageous effects are provided.

(1) The erroneous loading can be prevented beforehand. When the cartridge is loaded, the projection at the predetermined position opens a protection cover. The cover opens only when the ink cartridge is inserted. Therefore, even if the operator erroneously tries to load a different kind of cartridge, the cover does not open, thus preventing erroneous loading of the cartridge.

(2) The mounting operation is easier. In this embodiment, the direction of the projection is the same as the ink cartridge inserting direction, and therefore, the operator can easily judge the inserting direction from the configuration of the ink cartridge. Therefore, the operator is able to quickly understand the inserting direction without difficulty.

(3) Contamination by the ink can be prevented. This is because usually, the operator does not try to put the ink cartridge so that the projection contacts the table or the like. The plug or the opening which may be contaminated with the ink are not contacted to the table or the like. Because of the dimensions of the ink cartridge described hereinbefore, if the operator places the ink cartridge 27 so that it stands with the rubber plug 342 (or opening 342*a*) side facing down, or even if the operator tries to do so, the plug 342 or the opening 305 does not contact the surface 600 of the table or the like. Thus, the table or the like is prevented from being contaminated with the ink.

Whether the ink cartridge stands or can not stand in that manner is dependent on the thickness of the projection or the configuration thereof. The present invention is intended to cover both cases.

(4) The mechanism for opening and closing the cover is simplified, and the size thereof is minimized.

In this embodiment, the cover opening and closing mechanism is engageable with the projection of the cartridge, and therefore, it requires only small additional space, and the structure is simple.

The present invention is particularly suitably usable in an ink jet recording head and recording apparatus wherein thermal energy by an electrothermal transducer, laser beam or the like is used to cause a change of state of the ink to eject or discharge the ink. This is because the high density of the picture elements and the high resolution of the recording are possible.

The typical structure and the operational principle are preferably the ones disclosed in U.S. Pat. Nos. 4,723,129 and 4,740,796. The principle and structure are applicable to a so-called on-demand type recording system and a continuous type recording system. Particularly, however, it is suitable for the on-demand type because the principle is such that at least one driving signal is applied to an electrothermal transducer disposed on a liquid (ink) retaining sheet or liquid passage, the driving signal being enough to provide such a quick temperature rise beyond a departure from nucleation boiling point, by which the thermal energy is provided by the electrothermal transducer to produce film boiling on the heating portion of the recording head, whereby a bubble can be formed in the liquid (ink) corresponding to each of the driving signals. By the production, development and contraction of the the bubble, the liquid (ink) is ejected through an ejection outlet to produce at least one droplet. The driving signal is preferably in the form of a pulse, because the development and contraction of the bubble can be effected instantaneously, and therefore, the liquid (ink) is ejected with quick response. The driving signal in the form of the pulse is preferably such as disclosed in U.S. Pat. Nos. 4,463,359 and 4,345,262. In addition, the temperature increasing rate of the heating surface is preferably such as disclosed in U.S. Pat. No. 4,313,124.

The structure of the recording head may be as shown in U.S. Pat. Nos. 4,558,333 and 4,459,600 wherein the heating portion is disposed at a bent portion, as well as the structure of the combination of the ejection outlet, liquid passage and the electrothermal transducer as disclosed in the above-mentioned patents. In addition, the present invention is applicable to the structure disclosed in Japanese Laid-Open Patent Application No. 123670/1984 wherein a common slit is used as the ejection outlet for plural electrothermal transducers, and to the structure disclosed in Japanese Laid-Open Patent Application No. 138461/1984 wherein an opening for absorbing pressure wave of the thermal energy is formed corresponding to the ejecting portion. This is because the present invention is effective to perform the recording operation with certainty and at high efficiency irrespective of the type of the recording head.

The present invention is effectively applicable to a so-called full-line type recording head having a length corresponding to the maximum recording width. Such a recording head may comprise a single recording head and plural recording heads combined to cover the maximum width.

In addition, the present invention is applicable to a serial type recording head wherein the recording head is fixed on the main assembly, to a replaceable chip type recording head which is connected electrically with the main apparatus and can be supplied with the ink when it is mounted in the main assembly, or to a cartridge type recording head having an integral ink container.

The provisions of the recovery means and/or the auxiliary means for the preliminary operation are preferable, because they can further stabilize the effects of the present invention. As for such means, there are capping means for the recording head, cleaning means therefor, pressing or sucking means, preliminary heating means which may be the electrothermal transducer, an additional heating element or a combination thereof. Also, means for effecting preliminary ejection (not for the recording operation) can stabilize the recording operation.

As regards the variation of the recording head mountable, it may be a single corresponding to a single color ink, or may be plural corresponding to the plurality of ink materials having different recording color or density. The present invention is effectively applicable to an apparatus having at least one of a monochromatic mode mainly with black, a multi-color mode with different color ink materials and/or a full-color mode using the mixture of the colors, which may be an integrally formed recording unit or a combination of plural recording heads.

Furthermore, in the foregoing embodiment, the ink has been liquid. It may be, however, an ink material which is solidified below the room temperature but liquefied at the room temperature. Since the ink is controlled within the temperature not lower than 30° C. and not higher than 70° C. to stabilize the viscosity of the ink to provide the stabilized ejection in usual recording apparatus of this type, the ink may be such that it is liquid within the temperature range when the recording signal is present and is applicable to other types of ink. In one of them, the temperature rise due to the thermal energy is positively prevented by consuming it for the state change of the ink from the solid state to the liquid state. Another ink material is solidified when it is left, to prevent the evaporation of the ink. In either of the cases, the application of the recording signal producing thermal energy, the ink is liquefied, and the liquefied ink may be ejected. Another ink material may start to be solidified at the time when it reaches the recording material. The present invention is also applicable to such an ink material as is liquefied by the application of the thermal energy. Such an ink material may be retained as a liquid or solid material in through holes or recesses formed in a porous sheet as disclosed in Japanese Laid-Open Patent Application No. 56847/1979 and Japanese Laid-Open Patent Application No. 71260/1985. The sheet is faced to the electrothermal transducers. The most effective one for the ink materials described above is the film boiling system.

The ink jet recording apparatus may be used as an output terminal of an information processing apparatus such as computer or the like, as a copying apparatus combined with an image reader or the like, or as a facsimile machine having information sending and receiving functions.

As described in the foregoing, according to the present invention, the small and simple structure is enough to prevent the erroneous mounting of the ink cartridge and from the contamination with the ink.

While the invention has been described with reference to the structures disclosed herein, it is not confined to the details set forth and this application is intended to cover such modifications or changes as may come within the purposes of the improvements or the scope of the following claims.

What is claimed is:

1. An ink cartridge for insertion into an ink jet apparatus where the ink jet apparatus includes a cartridge mounting portion; an ink jet recording head for effecting recording on a recording material, the recording head being supplied with ink from the ink cartridge mounted on the cartridge mounting portion; a movable cover provided in the cartridge mounting portion and disposed so as to block an insertion path of the ink cartridge into the ink jet apparatus; blocking means for preventing opening movement of the cover, the blocking means being disposed at a portion inside of the cover; ink supply means connectable with the ink cartridge is loaded in said apparatus to permit supply of ink from the ink cartridge to the recording head; and means for feeding the recording material to a recording position for recording, the ink cartridge comprising:

a casing;

an ink container provided in said casing;

an ink absorbing material provided in said casing;

an ink supply port in communication with said ink container to supply ink from said ink container to an outside of said casing, said ink supply port being provided in a side of said casing;

an ink receiving port for receiving residual ink, said receiving port being provided in said side of said casing in communication with said ink absorbing material; and a projection extended outwardly from said casing in a direction away from said side of said casing and in a direction of insertion of said ink cartridge into said ink jet apparatus, wherein said projection has a height such that said ink supply port and said ink receiving port are inside of a line connecting an outside edge of said projection and an edge of said side of said casing, and said projection is fixed at a corner of said side of said casing.

* * * * *

UNITED STATES PATENT AND TRADEMARK OFFICE

CERTIFICATE OF CORRECTION

PATENT NO. : 5,541,631

DATED : July 30, 1996

INVENTOR(S) : KENICHIROU HASHIMOTO

It is certified that error appears in the above-identified patent and that said Letters Patent is hereby corrected as shown below:

On the title page, item:

[56] REFERENCES CITED

Foreign Patent Documents, "401075249" should read --64-75249--.

FIGURE 10A

Reference numeral "408" should read --410--.

FIGURE 11

Reference numeral "408 should read --410--.

COLUMN 1

Line 35, "operators" should read --operator's--.
Line 66, "lack" should read --lock--.

COLUMN 2

Line 33, "stably" should read --to stably--.
Line 34, "being faced down" should read --faces downward--.

COLUMN 4

Line 13, "rotates" should read --rotate--.
Line 37, "roller 28" should read --roller 5--.
Line 49, "character" should be deleted.

UNITED STATES PATENT AND TRADEMARK OFFICE

CERTIFICATE OF CORRECTION

PATENT NO. : 5,541,631

DATED : July 30, 1996

INVENTOR(S) : KENICHIROU HASHIMOTO

It is certified that error appears in the above-identified patent and that said Letters Patent is hereby corrected as shown below:

COLUMN 5

Line 13, "gap 13" should read --cap 13--.
Line 50, "described" should read --made--.
Line 66, "in" should be deleted.

COLUMN 6

Line 29, "into" should be deleted.
Line 47, "contact 306A" should read --contacts 306A--.

COLUMN 7

Line 11, "(4)," should read --(4)--.
Line 12, "cartridge 24" should read --cartridge 27--.
Line 16, "its abut" should read --it abuts--.
Line 21, "contact 306A" should read --contacts 306A--.
Line 54, "contact 306A" should read --contacts 306A--.
Line 60, "contact 306A" should read --contacts 306A--.

COLUMN 8

Line 5, "contact 306A" should read --contacts 306A--.
Line 45, "pro-" should read --prompted--.
Line 46, "moted" should be deleted.
Line 56, "contact" should read --contacts--.
Line 67, "above described" should read --above-described--.

UNITED STATES PATENT AND TRADEMARK OFFICE

CERTIFICATE OF CORRECTION

PATENT NO. : 5,541,631

DATED : July 30, 1996

INVENTOR(S) : KENICHIROU HASHIMOTO

It is certified that error appears in the above-identified patent and that said Letters Patent is hereby corrected as shown below:

COLUMN 9

Line 5, "leading" should read --reading--.
Line 30, "matters" should read --matter--.
Line 34, "which" should be deleted, and "of" should read --on--.
Line 44, "matters" should read --matter--.
Line 58, "stopper 406b" should read --stopper 406--.

COLUMN 10

Line 7, "cartridge 405" should read --cartridge 27-- and "projection 405" should read --projection 405a--.
Line 13, "cover 406," should read --cover 401,--.
Line 19, "projection 406a" should read --projection 405a--.
Line 40, "frame 408" should read --frame 410--.
Line 49, "in" should be deleted.
Line 58, "4:14 mm:" should read --4; 14 mm:--.

COLUMN 11

Line 17, "35a." should read --35.--.

COLUMN 12

Line 14, "the the" should read --the--.
Line 35, "wave" should read --waves--.

UNITED STATES PATENT AND TRADEMARK OFFICE

CERTIFICATE OF CORRECTION

PATENT NO. : 5,541,631

DATED : July 30, 1996

INVENTOR(S) : KENICHIROU HASHIMOTO

It is certified that error appears in the above-identified patent and that said Letters Patent is hereby corrected as shown below:

COLUMN 13

Line 41, "from" should be deleted.

COLUMN 14

Line 29, "receiving" should read --ink receiving--.

Signed and Sealed this

Twenty-eighth Day of January, 1997

*Attest:*

Bruce Lehman

BRUCE LEHMAN

*Attesting Officer*

*Commissioner of Patents and Trademarks*